US009233391B2

(12) United States Patent
Hangley

(10) Patent No.: US 9,233,391 B2
(45) Date of Patent: Jan. 12, 2016

(54) REMOVABLE GUIDE FOR AN APPLICATOR FOR APPLYING RESIN TO CREASES IN A GARMENT

(71) Applicant: James Hangley, Long Beach, NY (US)

(72) Inventor: James Hangley, Long Beach, NY (US)

( * ) Notice: Subject to any disclaimer, the term of this patent is extended or adjusted under 35 U.S.C. 154(b) by 25 days.

(21) Appl. No.: 14/178,694

(22) Filed: Feb. 12, 2014

(65) Prior Publication Data

US 2015/0224533 A1 Aug. 13, 2015

(51) Int. Cl.
*B05C 17/005* (2006.01)

(52) U.S. Cl.
CPC ..... *B05C 17/0052* (2013.01); *B05C 17/00516* (2013.01); *B05C 17/00503* (2013.01)

(58) Field of Classification Search
CPC ..... B05C 17/00503; B05C 17/00516
USPC ..... 401/132, 193
See application file for complete search history.

(56) References Cited

U.S. PATENT DOCUMENTS 1,086,796 A * 2/1914 Tarrant ..... 404/107
3,279,971 A * 10/1966 Gardener ..... 425/192 R
3,349,971 A * 10/1967 Poletajev ..... 222/191
3,594,089 A * 7/1971 Powell et al. ..... 401/9
5,046,877 A * 9/1991 Longo ..... 401/266
5,250,145 A * 10/1993 Despins et al. ..... 156/578
5,865,555 A * 2/1999 Dawson ..... 401/266
6,220,485 B1 * 4/2001 Chang ..... 222/174
6,981,611 B2 * 1/2006 Carruth et al. ..... 222/1
7,695,210 B1 * 4/2010 Martinez ..... 401/193
8,256,978 B2 * 9/2012 Bencsics et al. ..... 401/268
2004/0169053 A1 * 9/2004 Liljeqvist ..... 222/611.1

* cited by examiner

*Primary Examiner* — David Walczak
*Assistant Examiner* — Joshua Wiljanen
(74) *Attorney, Agent, or Firm* — Richard B. Klar, Esq.; Law Office Richard B. Klar

(57) ABSTRACT

A removable guide for use in an applicator configured to be irremovably attached to an underside of a cartridge. The guide has a fin shaped bottom located rearward for guiding the applicator along creases in a garment. The guide preferably has an opening or notch at its forward most central portion to engage the tip to ensure alignment with the tip when dispensing resin from the cartridge. The top side wall portions of the guide dips down or has a lower side width than the sidewall portions nearer the tip for easier disengagement of the guide from the cartridge.

9 Claims, 2 Drawing Sheets

REMOVABLE GUIDE FOR AN APPLICATOR FOR APPLYING RESIN TO CREASES IN A GARMENT

BACKGROUND

1. Field

The present invention relates to an improved removable guide for use in an applicator for dispensing resin into creases in a garment. The applicator is comprised of a tip, a resin filled cartridge, pneumatic receiver head and the removable guide. In particular the present invention relates to a removable guide as part of an applicator configured to be removably attached to an underside of a cartridge. The removable guide has a fin shaped bottom portion extending over the entire rearward portion of the removable guide for guiding the applicator along creases in a garment.

2. The Related Prior Art

Applicators provide for supplying resin in the creases of garments so that permanent creases can be provided for these garments. It is essential to provide a dispensing mechanism that can ensure for a better and a more accurate dispensing of resin in the creases and for guiding the dispensing mechanism along the creases.

U.S. Pat. No. 6,929,161 to Houlbrook discloses a cartridge for dispensing fluent materials into creases of a garment. The device of Houlbrook requires the cartridge not to be refilled. It does not provide for a removable guide for reuse with other cartridges. Further the device of Houlbrook does not have a removable mechanism to ensure that the guide can be aligned with the applicator to better ensure resin dispensing accurately into the apex of the creases of a garment.

The inventor of the present application has a pending U.S. patent application Ser. No. 13/385,824 filed on Mar. 8, 2012 in which an applicator includes a piston driven cartridge filled with resin/adhesive preferably silicone and has a guide located behind a receiver head that is attached, preferably clipped onto the rear end of the cartridge.

SUMMARY

The present invention provides for an improved removable guide for use in an applicator for dispensing resin in creases in a garment that overcomes the shortcoming of the aforementioned prior art proposals.

The present invention does this by providing a removable guide for use in an applicator configured to be removably attached to an underside of a cartridge of resin. The applicator has a tip for dispensing resin, a pneumatic receiver head used to propel the resin from the cartridge and the removable guide which has a fin shaped bottom for guiding the applicator along creases in a garment. The fin is located at the rearward portion of the removable guide encouraging the nozzle to remain in full contact with the crease of the garment as resin is applied along its length. The removable guide preferably has an opening or notch at its forward most portions wherein it engages the nozzle to ensure alignment with the nozzle when dispensing resin from the applicator. The top side portions of the guide dip down or have a lower side width than the side potions nearer the nozzle for easier disengagement of the removable guide from the cartridge.

DETAILED DESCRIPTION OF THE PREFERRED EMBODIMENT(S)

Figure 1:
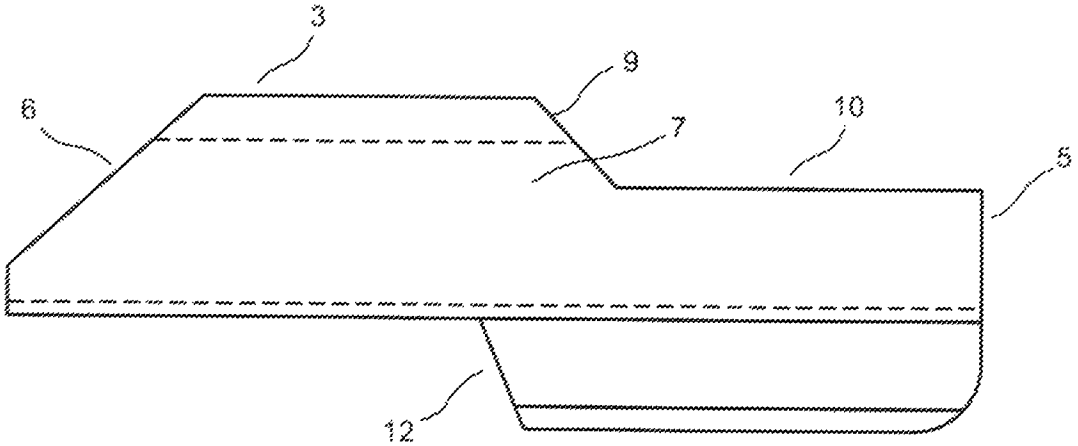
FIG. 1 is a sectional view of the removable guide adapted to be attached to a cartridge in accordance with the teachings of the present invention.
Figure 2:
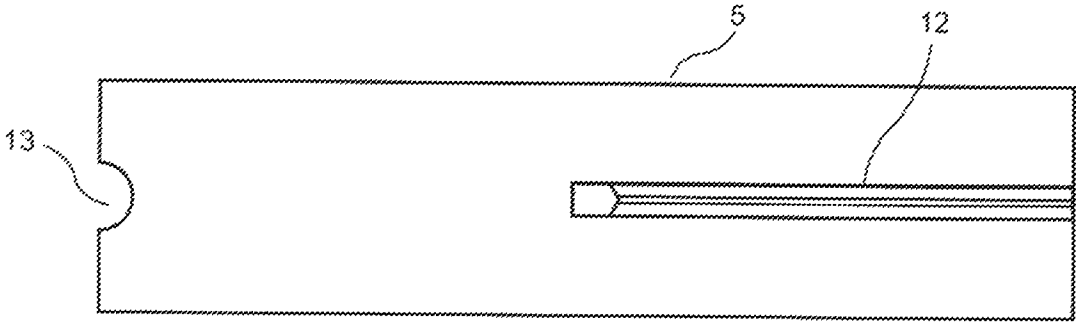
FIG. 2 is a bottom view of the guide of FIG. 1.
Figure 3:
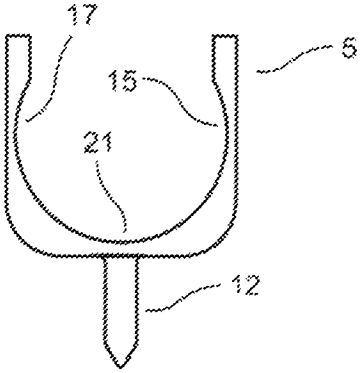
FIG. 3 is an end view of the guide of FIG. 1.

Referring now to the drawings of FIGS. 1-4, FIG. 1 shows a sectional view of the removable guide 5 of the present invention. As can be seen the upper forward side portion 3 of the guide 5 has a first slanting edge 6 and has a somewhat trapezoidal shape 7. The rear side of the upper forward side portion 10 of the guide 5 has a second slanting edge 9 slanting downward toward the rear which then continues as rearward upper side portion 9 that has a side wall that is narrower than the upper forward side portion 3 of the removable guide 5. The other side wall of the guide 5 is symmetrical in configuration and description to what has just been described. The removable guide 5 as shown in FIG. 3 has a preferably U-shaped configuration 17 (see FIG. 3) formed of the two side walls and a hollowed center area 21 in which an cartridge can be securely but removably placed within so that it is recessed between the two sidewalls of the guide 5 (see FIGS. 3 and 4). The removable guide 5 has a rearward positioned fin shaped bottom or blade 12 for guiding the applicator 26 along the crease in a garment as seen in FIGS. 1, 2, 3, and 4. The blade by nature of its rearward position encourages positive contact between the tip and the garment.

Figure 4:
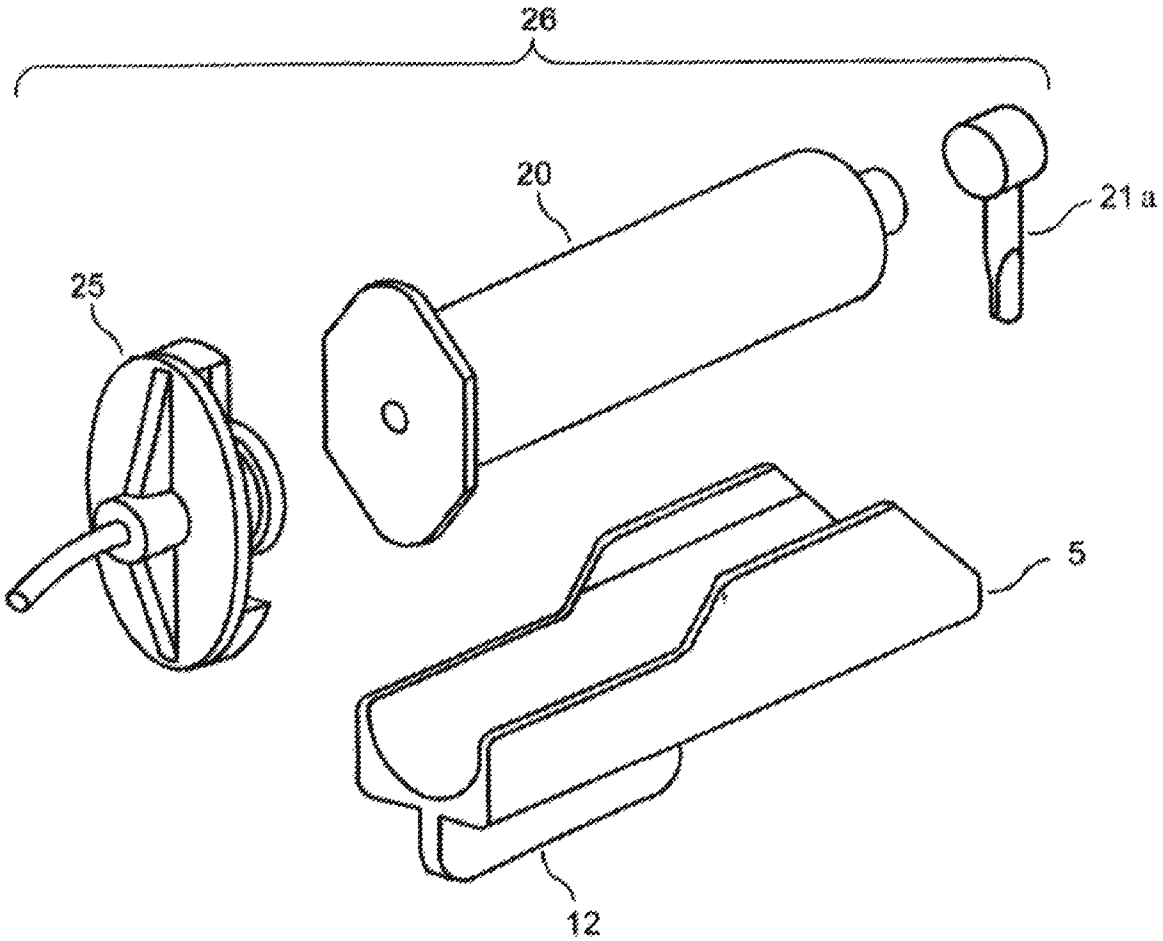
FIG. 4 is a partially exploded view of the applicator, comprised of the removable guide of FIG. 1 resin cartridge, tip, and pneumatic receiver head, in accordance with the teachings of the present invention.

The guide is preferably made of plastic material such as but not limited to polyethylene such as is manufactured under the trademark DELRIN® by DuPont. The center foremost part of the guide 5 is preferably configured to have a notch 13 (FIG. 2) for engaging the tip 21 (FIG. 4). In this way the guide blade or fin 12 can be aligned with the tip 21 to better ensure resin dispensing accurately into the apex of the creases of a garment.

The guide 5 is thus configured to be easily and conveniently removed from applicator 26 (FIG. 4) so that guide 5 can be reused with new cartridges 20. The guide 5 can be made inexpensively by injection mold technology or machining thus reducing the cost of the guide 5 and permitting their reuse for multiple times. The guide 5 is easy to remove in part because the rear side walls are narrower than the front side wall portions making it convenient to either lift the cartridge 20 out of or to insert the cartridge 20 into the guide 5.

The guide 5 is structured as follows:

As can be seen from FIG. 3 a removable guide 5 is generally U shaped to accommodate a cartridge for insertion therein. The removable guide 5 is preferably injection molded or machined of a plastic material making it cheaper and more efficient to manufacture. The removable guide 5 has opposing side walls on both sides of its generally U-shaped configuration. Each side wall has an upper front portion side wall 3 and an upper rear side wall portion 10. The front upper sidewall portions 3, resembling a trapezoidal shape, each terminate in a downward first slanting edge 6 toward the front of the guide 5 with a notch located centrally between them. The notch 13 accommodates the tip 21 to hold it in place and to ensure that the guide 5 is aligned for better and more accurate dispensing of the adhesive resin by the tip 21. The upper front side wall portions 3 also have a rearward second slanting edge 9 that extends into the upper rear sidewall portions 10 which have a lower height than the upper front sidewall portions 3. This makes it easier to insert or remove the cartridge 20 from the upper rear sidewall portions 10 of the guide 5. A guide blade 12 is disposed along the bottom of the removable guide 5 and extends throughout the length of the upper rear side wall portions 10 of the guide 5 and beyond the first slanting edge portions 9 and into part of the upper front sidewalk portions 3 having a trapezoidal shape.

A pneumatic receiver head 25 in FIG. 4 is attached to the rearward portion of the resin cartridge 20 and using pneumatic air pressure expels resin from the cartridge 20 through the tip 21 into the crease of a garment assisted by the guide 5.

While presently preferred embodiments have been described for purposes of the disclosure, numerous changes in the arrangement of method steps and apparatus parts can be made by those skilled in the art. Such changes are encompassed within the spirit of the invention as defined by the appended claims.

What is claimed:

1. A removable guide for use in an applicator for dispensing resin increases in a garment, comprising:

a guide configured to be removably attached to an underside of a cartridge, said guide having a substantially U-shaped configuration formed of two side wails each having a first slanted edge and a hollowed center area in which a cartridge can be securely but removably placed within so that it is recessed between the two sidewalk of the guide; said guide having a fin shaped bottom portion for guiding the applicator along creases in a garment, wherein said guide, in between said first slanted edges, has a notch at its forward most central portion to engage and align a tip of said applicator when dispensing resin from said applicator, said guide being configured to be disposed horizontally and substantially parallel to said creases of said garment and said tip being aligned vertical and substantially perpendicular to said guide so that said tip dispenses said dispensing resin all along and within said creases of said garment.

2. The guide according to claim 1 wherein said fin shaped portion of said guide extends along an entire rear portion of said guide and part of a forward portion of said guide.

3. The guide according to claim 1 wherein said two side walls of said guide each have corresponding upper forward sidewall portions followed by lower corresponding rearward side wall portions wherein said rearward side wall portions have a lower side wall height than said forward side wall portions so that it is easier to disengage the cartridge from the rearward side wall portions guide.

4. The guide according to claim 1 wherein front side wall portions and said rearwards side wall portions are connected together by second slanting edge portions.

5. The guide according to claim 4 wherein said front sidewall portions have an approximate trapezoidal shape.

6. The guide according to claim 1 wherein said guide is made of a plastic material.

7. The guide according to claim 1 wherein the guide is injection molded.

8. The guide according to claim 1 wherein the guide is machined.

9. The guide according to claim 1 wherein the guide is removable from a cartridge and reusable.

* * * * *